US006966799B1

(12) United States Patent
Wang

(10) Patent No.: US 6,966,799 B1
(45) Date of Patent: Nov. 22, 2005

(54) FLAT PLUG

(76) Inventor: Peace Wang, No. 507, Wunsin S. 5th Rd., Nantu District, Taichung City (TW) 408

( * ) Notice: Subject to any disclaimer, the term of this patent is extended or adjusted under 35 U.S.C. 154(b) by 0 days.

(21) Appl. No.: 11/023,574

(22) Filed: Dec. 29, 2004

(51) Int. Cl.[7] ..... H01R 13/04
(52) U.S. Cl. ..... 439/694; 439/695
(58) Field of Search ..... 439/701, 694–696, 439/455, 466

(56) References Cited

U.S. PATENT DOCUMENTS 4,391,485 A * 7/1983 Urani ..... 439/687
5,863,364 A * 1/1999 Lin et al. ..... 156/73.1
6,089,924 A * 7/2000 Wang ..... 439/694
6,224,428 B1 * 5/2001 Chen et al. ..... 439/694
6,287,139 B1 * 9/2001 Seko et al. ..... 439/489
6,454,612 B1 * 9/2002 Wang ..... 439/694
6,471,365 B2 * 10/2002 Wang et al. ..... 362/84

* cited by examiner

*Primary Examiner*—Michael C. Zarroli
(74) *Attorney, Agent, or Firm*—Bacon & Thomas PLLC

(57) ABSTRACT

A flat plug includes a base, a cover coved on the base, and two L-shaped electrically conductive blades. The base includes two rooms, two opposite holding faces formed in each of the two rooms, and two through holes located at the two rooms. The two blades each includes a horizontal portion and a vertical portion. The two horizontal portions each has a length larger than the distance between the two opposite holding faces, each being forcedly wedged respectively into the room and held tight by the two holding faces. The two horizontal portions each are inserted through the through hole. Thus, the two blades are securely positioned before the assembly of the base and the cover.

9 Claims, 6 Drawing Sheets

FLAT PLUG

BACKGROUND OF THE INVENTION

1. Field of the Invention

The present invention relates generally to power systems, and more particularly to a flat plug.

2. Description of the Related Art

Referring to FIG. 9, a conventional flat plug 80 is comprised of a base 81, a cover 82, a bent guide member 83, two electrically conductive insert pins 84, and a semi-circular fastening ring 85. The base 81 includes at least two through holes 811 for inserting the insert pins 84 therethrough. The base 81 also includes a sidewall located around the through holes 811 for deepening through holes 811 and thereby holding the insert pins 84 further tight to secure the stability while the insert pins 84 work.

However, it is still difficult to effectively tightly hold the insert pins of the conventional flat plug while the plug is assembled even though the sidewall is provided for stabilizing the insert pins. The insert pins are still subject to deviation or upward protrusion to incur unstable quality of the flat plug and even a defective plug having off-center insert pins during the production.

SUMMARY OF THE INVENTION

The primary objective of the present invention is to provide a flat plug, which is easily assembled and which blades are securely positioned before the assembly thereof.

The foregoing objective of the present invention is attained by the flat plug, which is electrically connected with a distal end of a wire and comprised of a sheety base, a sheety cover, and at least two electrically conductive blades. The base includes a first chamber formed at one side thereof, two rooms defined in the first chamber, two through holes located respectively at the two rooms and running therethrough, a first opening defined at a side of the first chamber, a first wedge portion formed at the first opening, and two opposite holding faces formed respectively at each of the two rooms. The cover corresponds to the base in shape to be covered on the base, including a second chamber formed at one side thereof, a second opening defined at a side of the second chamber, and a second wedge portion formed at the second opening, for communication between the first and second chambers and enabling the first and second wedge portions to face against each other. The blades each includes a horizontal portion and a vertical portion. The two horizontal portions are forcedly wedged respectively into the two rooms of the base and held tight by the two holding faces and electrically connected with the wire. The two horizontal portions are inserted respectively through the two through holes of the base.

DETAILED DESCRIPTION OF PREFERRED EMBODIMENTS

Figure 1:
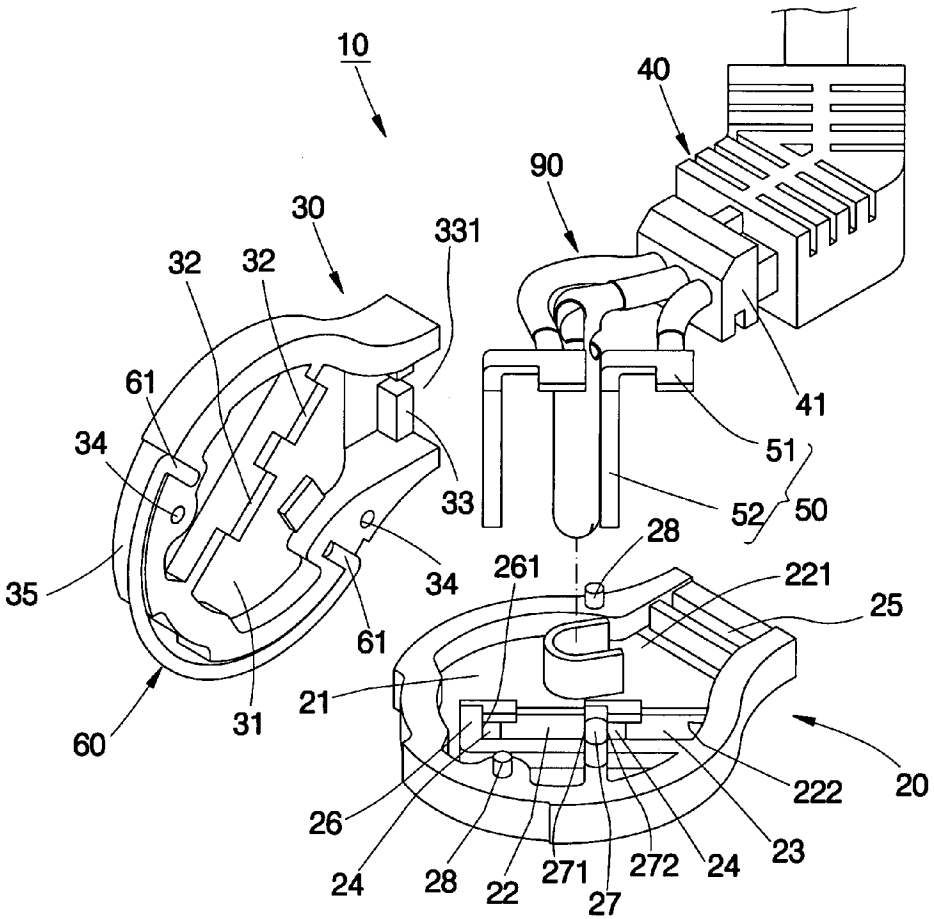
FIG. 1 is an exploded view of a first preferred embodiment of the present invention.
Figure 2:
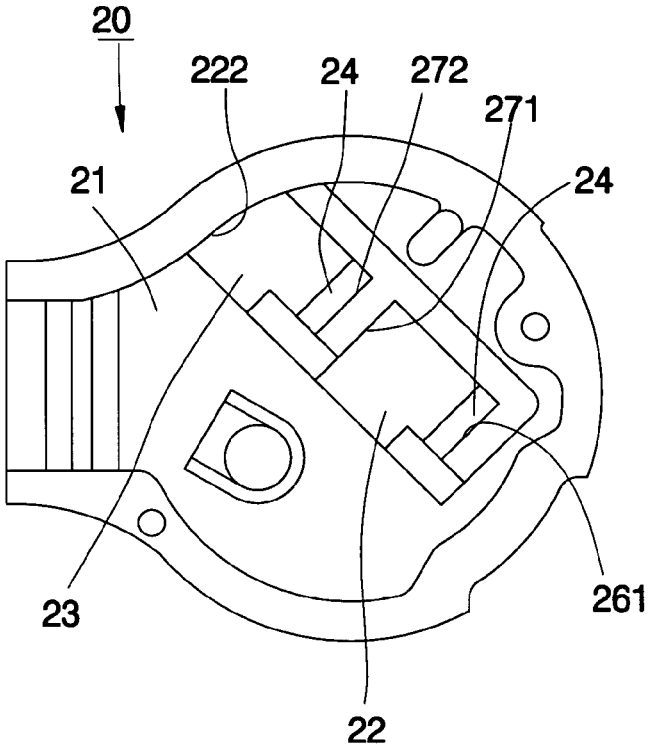
FIG. 2 is a top view of the base in accordance with the first preferred embodiment of the present invention.
Figure 3:
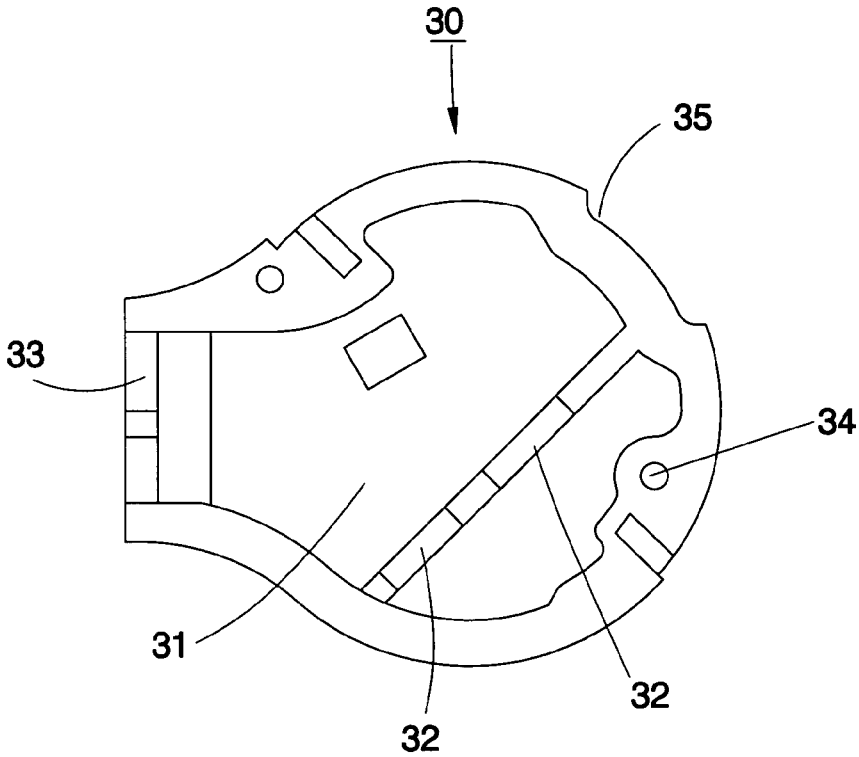
FIG. 3 is a bottom view of the cover in accordance with the first preferred embodiment of the present invention.

Referring to FIGS. 1–3, a flat plug 10 constructed according to a first preferred embodiment of the present invention is comprised of a base 20, a cover 30, a locating member 40, two electrically conductive blades 50, and a fastening ring 60.

The base 20 is a sheety member having a top side and a bottom side, including a first chamber 21 recessed from the top side thereof. The first chamber 21 has two rooms 22 and 23, two through holes 24 located respectively in the two rooms 22 and 23 and running through the base 20, and a first opening 221 defined at a free side thereof. A first wedge portion 25 is formed at the first opening 221 of the base 20. Two wedge walls 26 and 27 are formed in the first chamber 21 and located parallel to each other. The room 22 is defined between the two wedge walls 26 and 27. The room 23 is defined between the wedge wall 27 and an internal sidewall of the base 20 abutting the first chamber 21. Four holding faces 261, 271, 272, and 222 are formed respectively at two opposite sides of the wedge walls 26 and 27, the other side of the wedge wall 27, and the internal sidewall of the base 20 close to the wedge wall 27. Two posts 28 are formed on a periphery of the top side of the base 20 in proximity of the first chamber 21.

Figure 4:
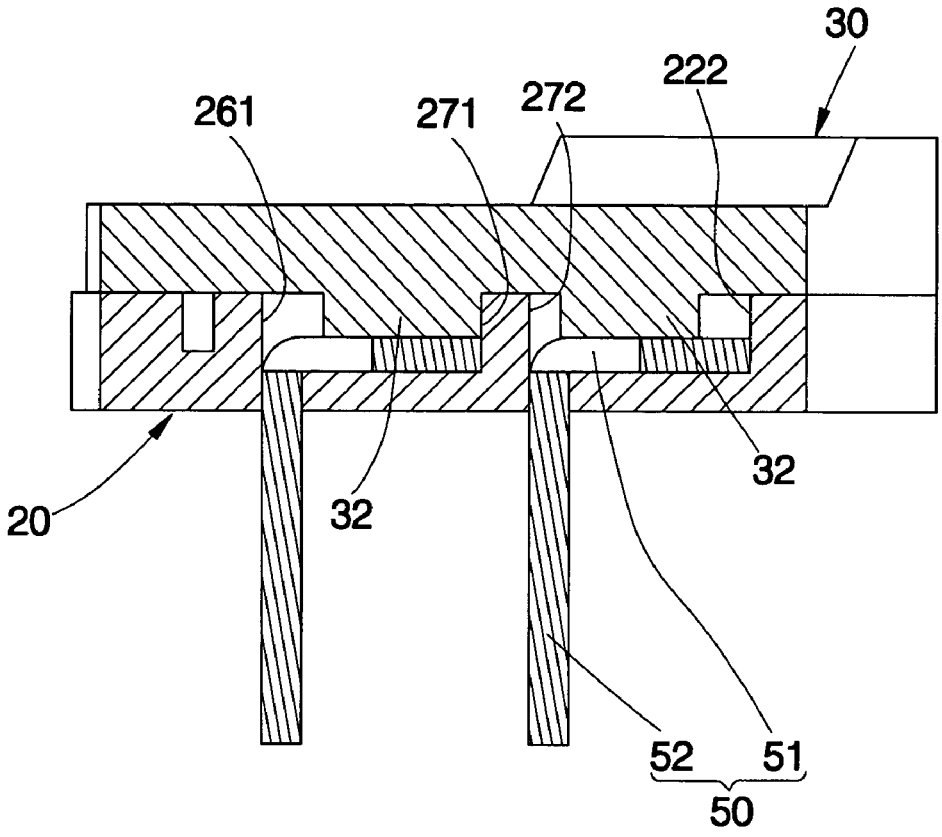
FIG. 4 is a sectional view of the first preferred embodiment of the present invention.
Figure 5:
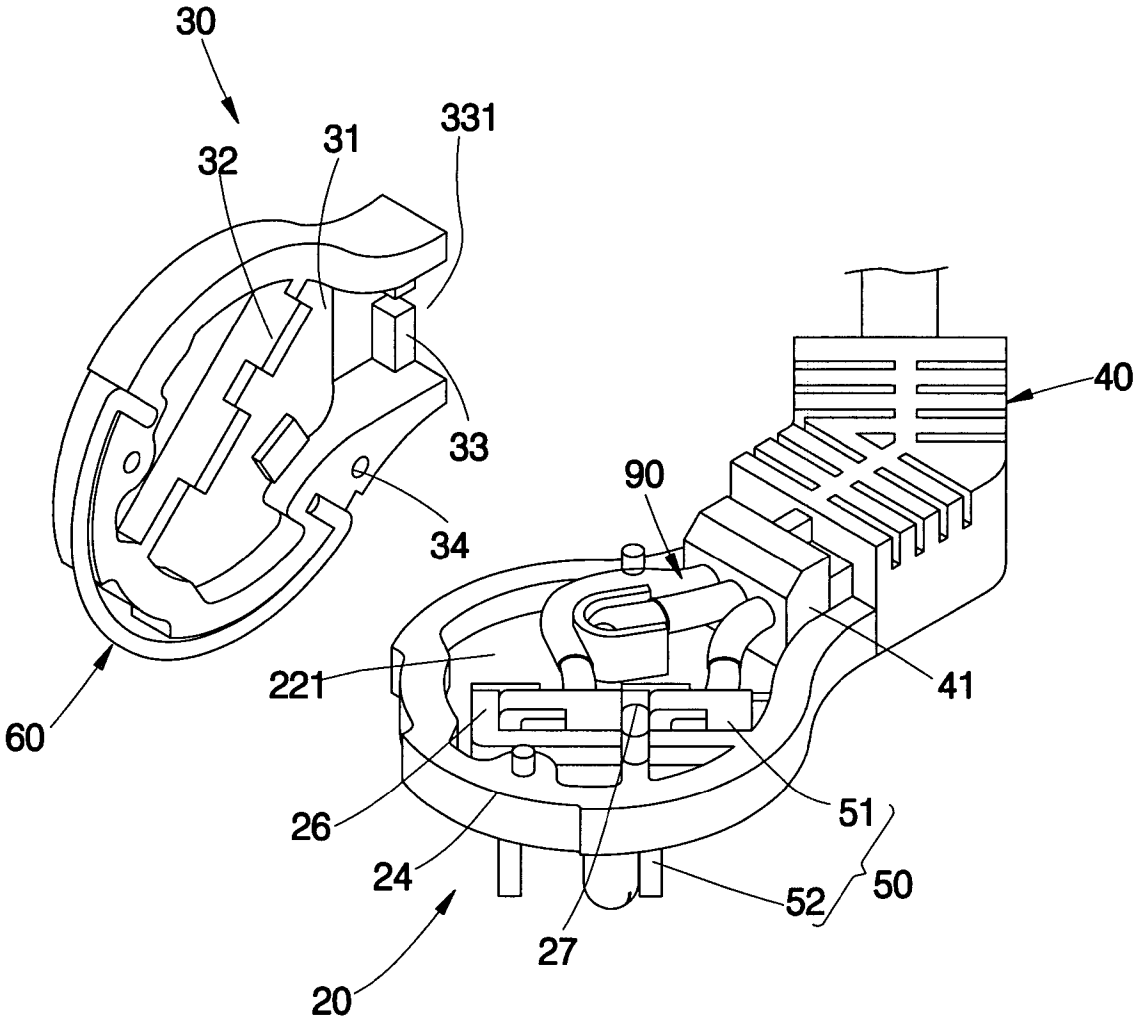
FIG. 5 is a partial exploded view of the first preferred embodiment of the present invention.
Figure 6:
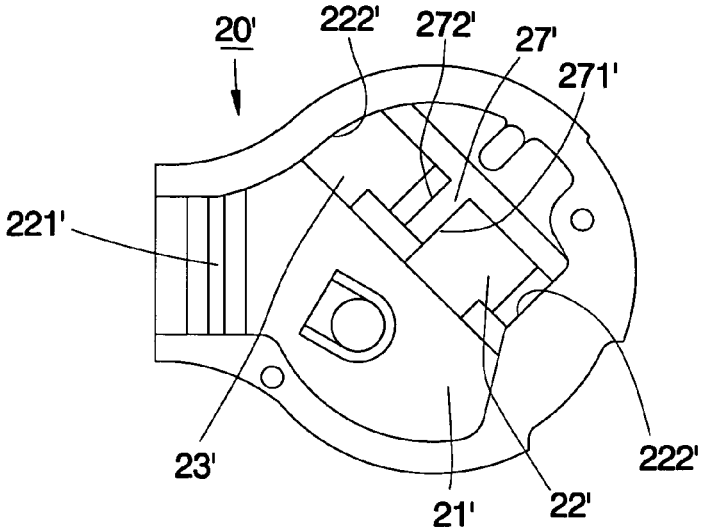
FIG. 6 is a top view of the base in accordance with a second preferred embodiment of the present invention.

Referring to FIGS. 4–5, the cover 30 is also a sheety member, corresponding to the base 20 in shape to be covered on the base 20 and having a top side and a bottom side. The cover 30 includes a second chamber 31 formed at the bottom side thereof, two forcing convexities 32 interconnected in the second chamber 31, a second opening 331 defined at a free side of the second chamber 31, a second wedge portion 33 formed at the second opening 331, two concavities 34 formed at a periphery of the bottom side thereof and abutting the second chamber 31, and a depressed portion 35 recessed at a peripheral edge thereof.

The locating member 40 is integrated with a wire 90 in one piece, which distal end runs through the locating member 40 from its rear end to its front end and extends for a length. The locating member 40 has a fastening portion 41 formed at the front end thereof for respectively engaging the first and second wedge portions 25 and 33 to be securely positioned.

The two electrically conductive blades 50 each are L-shaped, each having a horizontal portion 51 and a vertical portion 52. The two horizontal portions 51 each have a length larger than the distance between the two opposite holding faces 261 and 271 (272 and 222) of the room 22 (23). The two horizontal portions 51 can be forcedly wedged respectively into the two rooms 22 and 23, thereby each having two sides thereof tightly held between the two opposite holding faces 261 and 271 (272 and 222). The two vertical portions 52 are inserted respectively through the through holes 24 of the two rooms 22 and 23, parallel extending out of the bottom side of the base 20 for a length. The two horizontal portions 51 are heated by high frequency to be welded with the distal end of the wire 90 thereof.

The fastening ring 60 includes two hook portions 61 formed at two distal ends and pivotally mounted to a peripheral edge of the cover 30, for pivoting movement and being received in the depressed portion 35.

The operation of assembling the flat plug 10 is recited as follows. Each of the horizontal portions 51 of the two electrically conductive bladegs 50 is forcedly wedged into the two opposite holding faces 261 and 271 (272 and 222) to be securely fastened on the base 20, such that the two blades 50 are held tight without tremble. Then, the cover 30 is covered on the base 20 to let the two posts 28 tightly insert respectively into the two concavities 34 and let the two forcing convexities extend respectively into the two rooms 22 and 23 and then respectively squeeze the two horizontal portions 51 to hold the two blades 50 further securely tight. Further, since the fastening portion 41 of the locating member 40 engages the first and second wedge portions 25 and 33 of the base 20 and the cover 30, the base 20 and the cover 30 are not subject to disengagement from each other.

The flat plug constructed according to a second preferred embodiment of the present invention is similar to the first preferred embodiment, but having difference as recited below. The base 20' includes a wedge wall 27' formed in the first chamber 21', in which two rooms 22' and 23' are defined between the internal sidewall of the base 20' thereabout and the wedge wall 27' and the four holding faces 271', 272', and 222' are formed respectively at two opposite sides of each of the two rooms 22' and 23'.

Figure 7:
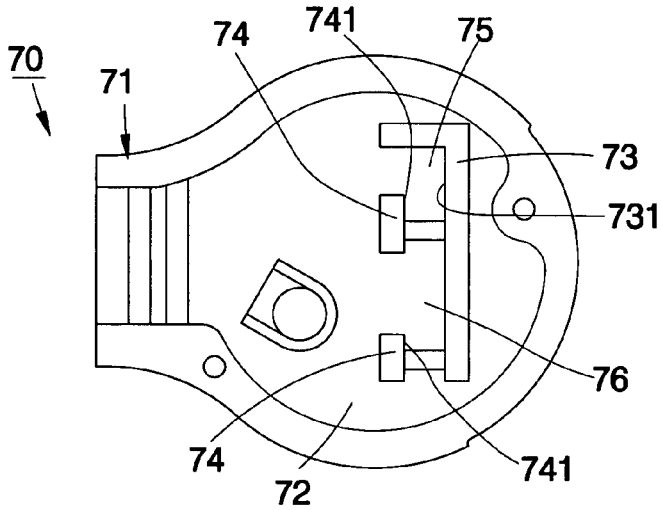
FIG. 7 is a top view of the base in accordance with a third preferred embodiment of the present invention.

Referring to FIG. 7, the flat plug 70 constructed according to a third preferred embodiment of the present invention is similar to the aforementioned preferred embodiments, but having difference as recited below. The base 71 includes a first wedge wall 73 at the first chamber 72, two second wedge walls 74 parallel to the first wedge wall 73, two rooms 75 and 76 defined between the first and second wedge walls 73 and 74, and two holding faces 731 and 741 formed in each of the two rooms 75 and 76 between two opposite sides of the two wedge walls 73 and 74.

Figure 8:
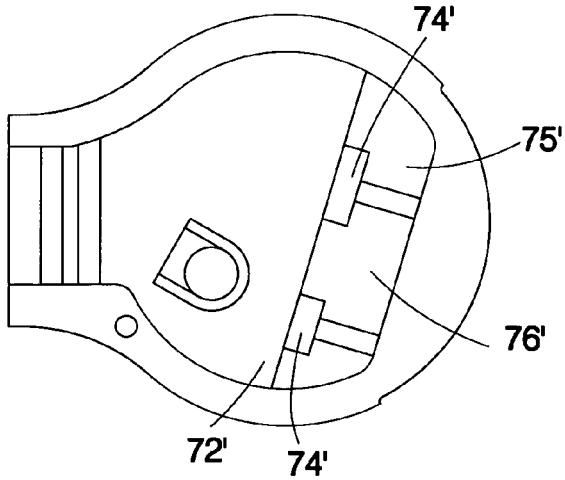
FIG. 8 is a top view of the base in accordance with a fourth preferred embodiment of the present invention.
Figure 9:
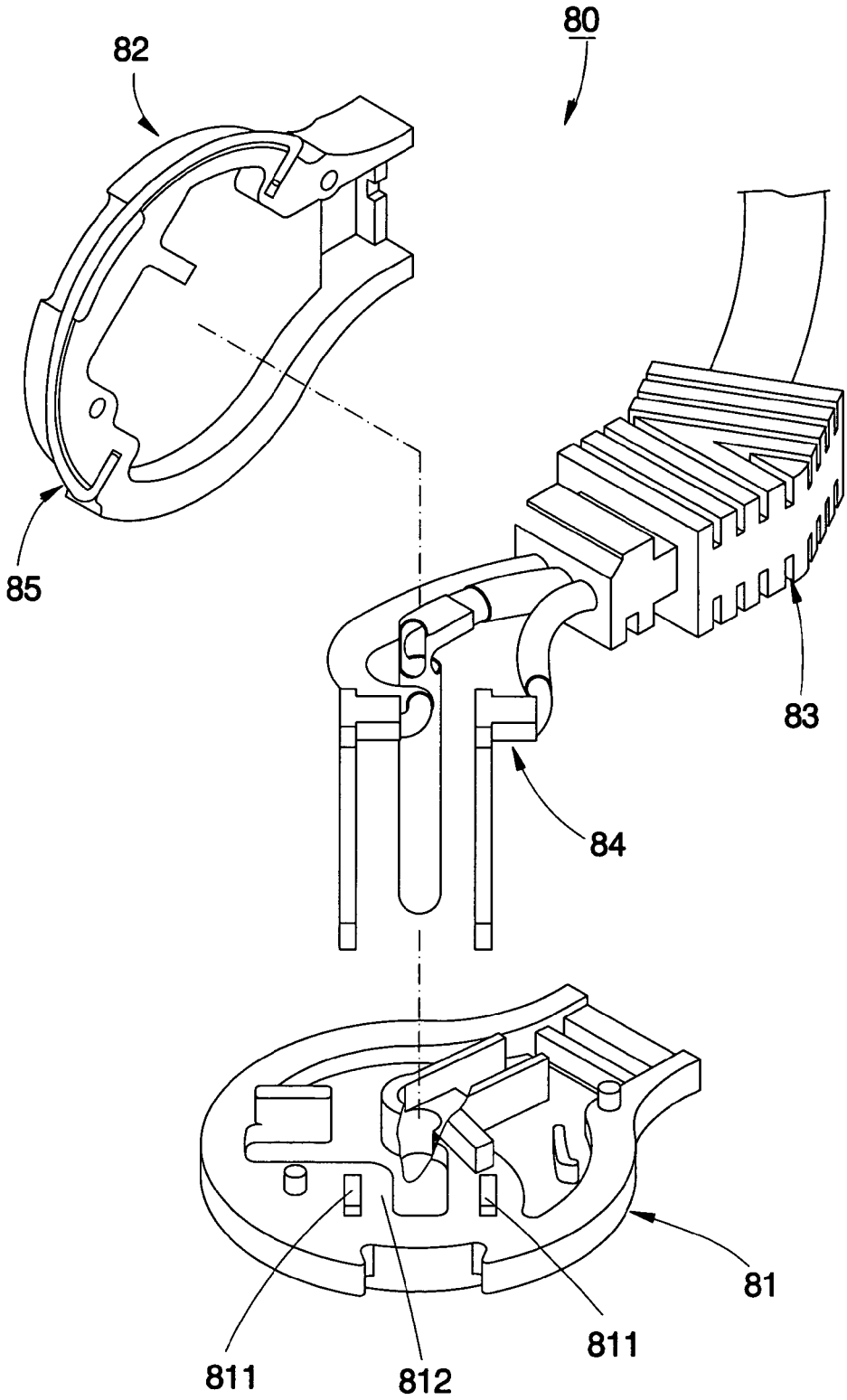
FIG. 9 PRIOR ART
FIG. 9 is an exploded view of a conventional flat plug.

Referring to FIG. 8, the flat plug 70 constructed according to a fourth preferred embodiment of the present invention is similar to the aforementioned preferred embodiments but different by that the base includes the two second wedge walls 74' only (without the first wedge wall) and the two rooms 75' and 76' are defined respectively between the internal sidewall of the first chamber 72' and the two second wedge walls 74'.

In conclusion, the present invention includes advantages as follows. Since the horizontal portions of the two blades can be forcedly wedged into the two rooms, the blades can be securely positioned to avoid defective mounting and to further ensure perfect assembly of the base and the cover, thereby expediting the assembly of the flat plug. Accordingly, the present invention is convenient and secure in assembly.

It is to be noted that the wedge wall is not limited by its number and location as long as the two blades can be quickly and accurately forcedly wedged into and held tight in the two rooms.

What is claimed is:

1. A flat plug electrically connected with a distal end of a wire, comprising:

a sheety base having a first chamber at its one side, two rooms formed in said first chamber, two through holes located in the said two rooms, a first opening defined at a side of said first chamber, a first wedge portion formed at said first opening, and two opposite holding faces formed at each of said two rooms;

a sheety cover corresponding to said base in shape and having a second chamber at its one side, a second opening defined at a side of said second chamber, and a second wedge portion formed at said second opening, said cover being covered on said base for communication between said first and second chambers and enabling said first and second wedge portions to face against each other; and at least two L-shaped electrically conductive blades each having a horizontal portion and a vertical portion, said two horizontal portions being electrically connected with said wire and each having a length larger than the distance between said two opposite holding faces, said two horizontal portions being positioned respectively in said two rooms and held by said two opposite holding faces of each of said two rooms, said two vertical portions being inserted respectively through said through holes of said two rooms.

2. The flat plug as defined in claim 1, wherein said base comprises a wedge wall formed in said first chamber; said two rooms being defined between two sides of said wedge wall and an internal sidewall of said base abutting said first chamber and having two holding faces formed at the two sides of said wedge wall and the internal sidewall of said base.

3. The flat plug as defined in claim 1, wherein said base comprises two opposite wedge walls formed in said first chamber; one of said two rooms is defined between said two wedge walls and the other of said two rooms is defined between one of said two wedge walls and an internal sidewall of said base abutting said first chamber.

4. The flat plug as defined in claim 1, wherein said base comprises a first wedge wall and at least two second wedge walls in said first chamber; said two rooms are defined between said first and second wedge walls.

5. The flat plug as defined in claim 1, wherein said cover comprises two forcing convexities located in said second chamber and extending respectively into said two rooms and squeezing said horizontal portions of said two blades.

6. The flat plug as defined in claim 1 further comprising a locating member integrated with said wire in one piece, said locating member having a fastening portion at its front end for engaging said first and second wedge portions of said base and said cover.

7. The flat plug as defined in claim 1 further comprising a fastening ring, said fastening ring having two hook portions at its two rear ends and pivotably mounted to said cover, said fastening ring corresponding to a peripheral edge of said cover in shape for lying against said peripheral edge of said cover.

8. The flat plug as defined in claim 7, wherein said cover comprises a depressed portion for receiving said fastening ring.

9. The flat plug as defined in claim 1, wherein said base comprises at least two posts; said cover comprises at least two concavities respectively for inserting said two posts therein.

* * * * *